US009355596B2

(12) United States Patent
Shin et al.

(10) Patent No.: US 9,355,596 B2
(45) Date of Patent: May 31, 2016

(54) ORGANIC LIGHT EMITTING DISPLAY DEVICE

(71) Applicant: Samsung Display Co., LTD., Yongin, Gyeonggi-do (KR)

(72) Inventors: Choong-Sun Shin, Yongin (KR); In-Bok Song, Yongin (KR); Jeong-Kyoo Kim, Yongin (KR); Young-Uk Won, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 324 days.

(21) Appl. No.: 14/022,117

(22) Filed: Sep. 9, 2013

(65) Prior Publication Data

US 2014/0320475 A1 Oct. 30, 2014

(30) Foreign Application Priority Data

Apr. 30, 2013 (KR) ..... 10-2013-0048706

(51) Int. Cl.
*G09G 3/32* (2006.01)

(52) U.S. Cl.
CPC ..... *G09G 3/3275* (2013.01); *G09G 3/3233* (2013.01); *G09G 2300/0819* (2013.01); *G09G 2320/0271* (2013.01); *G09G 2320/0295* (2013.01); *G09G 2320/045* (2013.01)

(58) Field of Classification Search
CPC ..... G09G 2300/0819; G09G 2320/0295; G09G 3/3275; G09G 3/3233; G09G 2320/0271; G09G 2320/045
USPC ..... 345/76–83, 212, 690
See application file for complete search history.

(56) References Cited

U.S. PATENT DOCUMENTS

| | | | | |
|---|---|---|---|---|
| 2009/0174628 | A1* | 7/2009 | Wang et al. | 345/76 |
| 2010/0123699 | A1 | 5/2010 | Leon et al. | |
| 2011/0025676 | A1* | 2/2011 | Kawashima | 345/212 |
| 2012/0019569 | A1* | 1/2012 | Byun | 345/690 |

FOREIGN PATENT DOCUMENTS

| | | | |
|---|---|---|---|
| KR | 10-2008-0007254 | A | 1/2008 |
| KR | 10-2011-0098914 | A | 9/2011 |
| KR | 10-2012-0068682 | A | 6/2012 |
| KR | 10-2012-0076215 | A | 7/2012 |
| KR | 10-2012-0093111 | A | 8/2012 |

* cited by examiner

*Primary Examiner* — Alexander Eisen
*Assistant Examiner* — Abhishek Sarma
(74) *Attorney, Agent, or Firm* — Lewis Roca Rothgerber Christie LLP

(57) ABSTRACT

An organic light emitting diode display including a display including data lines, scan lines, sense lines, and pixels electrically coupled to the data, scan, and sense lines, a compensator for sensing first and second driving currents flowing to the pixels corresponding to first and second test data in a compensation mode, to compare first and second reference currents with the first and second driving currents, respectively, and to update compensation data, a signal controller for compensating input data according to the compensation data to generate image data, and for changing the input data into the first and second test data in the compensation mode; and a data driver for generating a plurality of data signals by using one of the image data, the first and second test data, and to supply the data signals to the data lines.

13 Claims, 6 Drawing Sheets

ORGANIC LIGHT EMITTING DISPLAY DEVICE

CROSS-REFERENCE TO RELATED APPLICATION

This application claims priority to and the benefit of Korean Patent Application No. 10-2013-0048706, filed in the Korean Intellectual Property Office, on Apr. 30, 2013, the entire content of which is incorporated herein by reference.

BACKGROUND

1. Field

Embodiments of the present invention relate to an organic light emitting diode (OLED) display.

2. Description of the Related Art

A display device is used as a display for mobile information terminals such as a personal computer, a mobile phone, a personal digital assistant (PDA), and the like, or as a monitor of various information devices, and a liquid crystal display (LCD) using a liquid crystal panel, an organic light emitting diode (OLED) display device using organic light emitting elements, a plasma display panel (PDP), and the like, are widely known as the display device. Among them, an OLED display having excellent luminous efficiency, luminance, and viewing angle as well as a fast response speed has been the subject of much attention.

In the OLED display, a plurality of pixels are disposed in a matrix form on a substrate so as to be used as a display area, scan lines and data lines are connected to the pixels, and data signals are selectively applied to the pixels to display an image.

Such display devices can be categorized as a passive matrix light emitting display device or an active matrix light emitting display device depending on how pixels are driven. The passive matrix OLED display forms an anode to cross a cathode and selects a line to drive it.

The active matrix OLED display maintains a data signal, which is switched by a switching transistor, by using a capacitor, and applies the same to a driving transistor to control a current that flows to the OLED.

However, in the case of the active matrix OLED display, temperature change and/or pixel degradation may change the characteristics of the respective driving transistors, such as a threshold voltage (Vt) and/or charge mobility.

As a result of this change, even when the same data signal is applied to the driving transistors of the display pixels, there may be a difference between currents flowing to the respective OLEDs. As a result, each pixel may emit light with a different luminance.

In general, a driving current (I) flowing to the driving transistor and a driving voltage (V) corresponding to the data signal are related according to Equation 1.

$$I=k\times(V-Vt)^p \qquad \text{Equation 1}$$

Here, k is a variable relating to the mobility characteristic of the driving transistor, Vt is a variable relating to the threshold voltage characteristic, and p is a constant with a value of 1 to 2. Thus, for example, the mobility characteristic and the threshold voltage characteristic of the driving transistor can be acquired by using the relationship between the driving voltage (V) and the driving current (I).

As an example, when currents I1 and I2 flowing to the driving transistor for at least two voltage levels V1 and V2, respectively, of the driving voltage (V) are measured and substituted into Equation 1, two equations are calculated.

When variables k and Vt are acquired from two concurrent equations and are then used to compensate the data signal, a luminance difference among pixels can be reduced.

The above information disclosed in this Background section is only for enhancement of understanding of the background of the invention and therefore it may contain information that does not form the prior art that is already known in this country to a person of ordinary skill in the art.

SUMMARY

Because the above-noted method requires an exponentiation operation or a division operation, a floating point operation circuit or a lookup table may have to be used. Therefore, the display device hardware may become complicated.

According to an aspect of an embodiment of the present invention, there is provided an organic light emitting diode display including: a display including a plurality of data lines, a plurality of scan lines, a plurality of sense lines, and a plurality of pixels electrically coupled to the data lines, the scan lines, and the sense lines; a compensator configured to sense first driving currents and second driving currents flowing to the pixels corresponding to first test data and second test data, respectively, in a compensation mode, to compare first reference currents and second reference currents with the first driving currents and the second driving currents, respectively, and to update compensation data; a signal controller configured to compensate input data according to the compensation data to generate image data, and to change the input data into the first test data and the second test data in the compensation mode; and a data driver configured to generate a plurality of data signals by using one of the image data, the first test data, and the second test data, and to supply the data signals to the data lines.

The compensator may include: a current sensor configured to sense the first driving currents and the second driving currents through the sense lines in the compensation mode; a comparator configured to compare the first driving currents with the first reference currents to output first comparison data, and to compare the second driving currents with the second reference currents to output second comparison data; a compensation data processor configured to update the compensation data according to the first comparison data and the second comparison data; and a memory configured to store value of the first reference currents, value of the second reference currents, and the compensation data.

Each of the pixels may include: an organic light emitting diode; and a driving transistor configured to drive the organic light emitting diode according to one of the data signals.

Characteristic data of the driving transistor may include a mobility characteristic variable, a variation of the mobility characteristic variable, a threshold voltage characteristic variable, and a variation of the threshold voltage characteristic variable, and may be related according to $$Id=(k+\alpha)\times\{V\text{data}-(Vt-\beta))^p\}$$

where the Id is a current flowing to the driving transistor, the Vdata is a voltage corresponding to the data signal, k is the mobility characteristic variable, Vt is the threshold voltage characteristic variable, $\alpha$ is the variation of the mobility characteristic variable, and $\beta$ is the variation of the threshold voltage characteristic variable.

The compensation data processor may be further configured to store value of the first driving currents and value of the second driving currents flowing to the pixels in the memory as value of the first reference currents and value of the second reference currents, according to the first test data and the second test data at an initial operation.

The compensation data processor may be further configured to set the variation of the mobility characteristic variable and the variation of the threshold voltage characteristic variable as 0 at an initial operation.

The compensation data processor may be further configured to change the variation of at least one of the mobility characteristic variable or the threshold voltage characteristic variable by ±1 according to the first comparison data and the second comparison data.

The compensation data processor may be further configured to change the variation of the threshold voltage characteristic variable by +1 when a corresponding one of the first driving currents is less than a corresponding one of the first reference currents and a corresponding one of the second driving currents is less than a corresponding one of the second reference currents.

The compensation data processor may be further configured to change the variation of the threshold voltage characteristic variable by −1 when a corresponding one of the first driving currents is greater than a corresponding one of the first reference currents and a corresponding one of the second driving currents is greater than a corresponding one of the second reference currents.

The compensation data processor may be further configured to change the variation of the mobility characteristic variable and the variation of the threshold voltage characteristic variable by −1 when a corresponding one of the first driving currents is less than a corresponding one of the first reference currents and a corresponding one of the second driving currents is greater than a corresponding one of the second reference currents.

The compensation data processor may be further configured to change the variation of the mobility characteristic variable and the variation of the threshold voltage characteristic variable as +1 when a corresponding one of the first driving currents is greater than a corresponding one of the first reference currents and a corresponding one of the second driving currents is less than a corresponding one of the second reference currents.

The compensation data processor may be further configured to change the variation of the mobility characteristic variable by −1 when a corresponding one of the first driving currents is less than a corresponding one of the first reference currents and a corresponding one of the second driving currents is less than a corresponding one of the second reference currents.

The compensation data processor may be further configured to change the variation of the mobility characteristic variable by +1 when a corresponding one of the first driving currents is greater than a corresponding one of the first reference currents and a corresponding one of the second driving currents is greater than a corresponding one of the second reference currents.

The organic light emitting diode (OLED) display, according to aspects of the example embodiments of the present invention, compares the driving current of the driving transistor that is measured at the initial operation and the driving current that is measured in the compensation mode, and modifies at least one of the threshold voltage characteristic variable and the mobility characteristic variable comprised in the characteristic data of the driving transistor to update the characteristic data thereby simplifying the hardwired configuration and reducing the compensation processing time.

DETAILED DESCRIPTION

Figure 1:
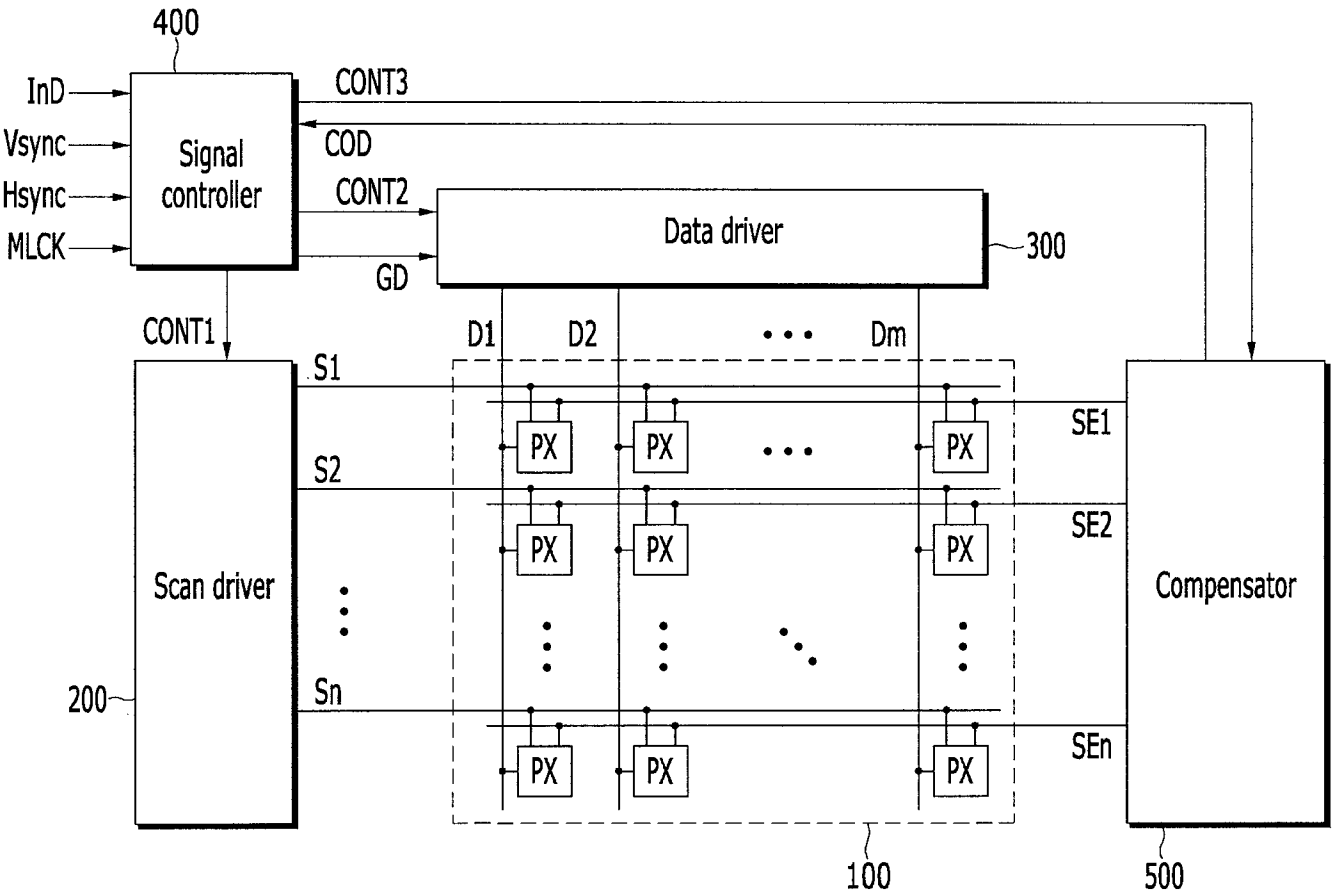
FIG. 1 shows an organic light emitting diode (OLED) display, according to an example embodiment of the present invention.

In the following detailed description, only certain example embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

In the following detailed description, only certain example embodiments of the present invention have been shown and described, simply by way of illustration.

FIG. 1 shows an organic light emitting diode (OLED) display, according to an example embodiment of the present invention.

Referring to FIG. 1, the OLED display includes a display 100, a scan driver 200, a data driver 300, a signal controller 400, and a compensator 500. The display 100 has a display area including a plurality of pixels PX, and it includes a plurality of scan lines for transmitting a plurality of scan signals S1-Sn, a plurality of data lines for transmitting a plurality of data signals D1-Dm, a plurality of wires for applying a first driving voltage ELVDD and a second driving voltage ELVSS, and a plurality of sense lines for transmitting a plurality of sense signals SE1-SEn.

Here, the pixels PX are electrically coupled to (e.g., connected to) the corresponding scan lines, the corresponding data lines, the corresponding sense lines, the first driving voltage ELVDD supply line, and the second driving voltage ELVSS supply line. Also, each of the pixels PX may include a red subpixel R for emitting red light, a green subpixel G for emitting green light, and a blue subpixel B for emitting blue light.

Figure 2:
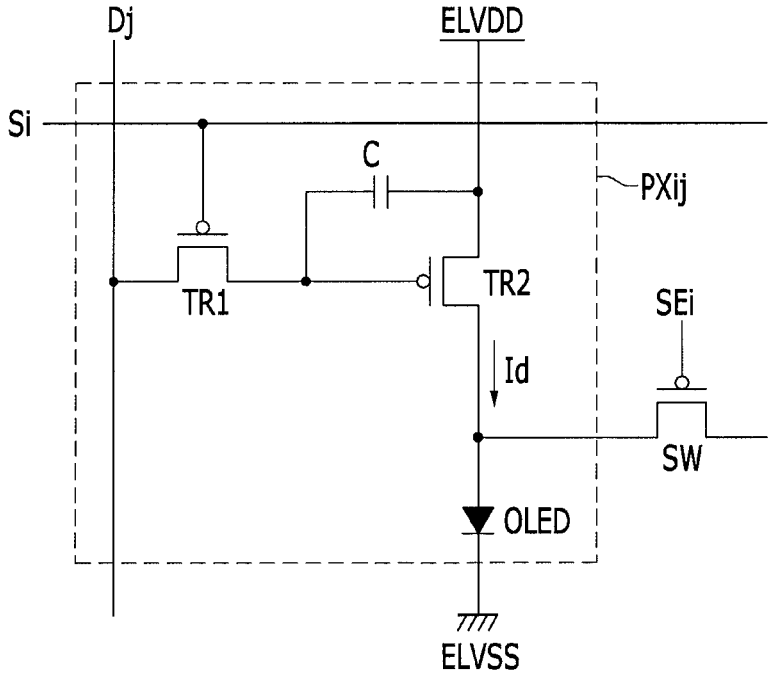
FIG. 2 shows an equivalent circuit diagram of a pixel PX, according to an example embodiment of the present invention.

As shown in FIG. 2, a pixel PXij electrically coupled to an i-th scan line for transmitting an i-th scan signal Si and a j-th data line for transmitting a j-th data signal Dj includes a switching transistor TR1, a driving transistor TR2, a capacitor C, and an organic light emitting diode OLED.

The switching transistor TR1 includes a gate electrode electrically coupled to the i-th scan line, a source electrode electrically coupled to the j-th data line, and a drain electrode electrically coupled to the gate electrode of the driving transistor TR2.

The driving transistor TR2 includes a source electrode electrically coupled to the wire for supplying (e.g., applying) a first driving voltage ELVDD, a drain electrode electrically coupled to the anode of the OLED, and a gate electrode for transmitting a driving voltage Vdata corresponding to the j-th data signal Dj while the switching transistor TR1 is turned on. The source electrode of the driving transistor TR2 is electrically coupled to a first end (e.g., electrode) of a switch SW. A second end (e.g., electrode) of the switch SW is electrically coupled to the compensator 500, and the switch SW is turned on by a sense signal SEi.

The capacitor C is electrically coupled between the gate electrode and the source electrode of the driving transistor TR2. The cathode of the organic light emitting diode OLED is electrically coupled to the wire for supplying (e.g., applying) the second driving voltage ELVSS.

In the above-configured pixel PXij, when the switching transistor TR1 is turned on by the scan signal Si, the data signal Dj is transmitted to the gate electrode of the driving transistor TR2. A voltage difference between the gate electrode and the source electrode of the driving transistor TR2 is maintained by the capacitor C, and the driving current Id flows to the driving transistor TR2. The organic light emitting diode OLED emits light according to the driving current Id.

The example embodiment of the present invention is not restricted to the above-described configuration, the pixel PXij shown in FIG. 2 is an example of the pixel of the display device, and other types of pixel configurations may be used.

Referring to FIG. 1, the scan driver 200 generates a plurality of scan signals S1-Sn according to the first drive control signal CONT1 and transmits them to the corresponding scan lines.

The data driver 300 samples and holds one of grayscale data GD and first and second test data TD1 and TD2 according to a second drive control signal CONT2, and transmits a plurality of data signals D1-Dm to a plurality of data lines according to horizontal synchronization.

The signal controller 400 receives input data InD from an external device, and generates the grayscale data GD using compensation data COD stored in the compensator 500 in the normal mode. The signal controller 400 generates the first and second test data TD1 and TD2 in a compensation mode.

Here, the signal controller 400 generates the first test data TD1 as grayscale data that correspond to a high grayscale value (e.g., a specific high grayscale value) of the input data InD and the second test data TD2 as grayscale data that correspond to a low grayscale value (e.g., a specific low grayscale value) of the input data InD. For example, the first test data TD1 may be full white grayscale data and the second test data TD2 may be black grayscale data.

The signal controller 400 receives a synchronization signal from an external device and generates a first drive control signal CONT1, a second drive control signal CONT2, and a third drive control signal CONT3 for controlling the scan driver 200, the data driver 300, and the compensator 500.

Here, the synchronization signal includes a horizontal synchronization signal Hsync, a vertical synchronization signal Vsync, and a main clock signal MCLK. The signal controller 400 distinguishes the input data InD per frame according to the vertical synchronization signal Vsync, and distinguishes the input data InD per scan line according to the horizontal synchronization signal Hsync to generate the grayscale data GD. The signal controller 400 activates the third drive control signal CONT3 in the compensation mode.

The compensator 500 is controlled by the third drive control signal CONT3, and senses the first and second driving currents Id1 and Id2 flowing to the pixels PX corresponding to the first and second test data TD1 and TD2. The compensator 500 compares the sensed first and second driving currents Id1 and Id2 with stored first and second reference currents Iref1 and Iref2.

Here, the first and second reference currents Iref1 and Iref2 are values that are acquired by measuring the driving currents flowing to the pixels PX according to the first and second test data TD1 and TD2 at the initial operation of the display panel. The compensator 500 updates the compensation data COD according to a comparison result.

In an embodiment, as expressed in Equation 2, the compensation data COD is updated according to increment and decrement amounts α and β of the mobility characteristic variable k and the threshold voltage characteristic variable Vt.

$$Id=(k+\alpha)\times\{(V\text{data}-(Vt+\beta))^p\} \quad \text{Equation 2}$$

where, as in Equation 1, p is a constant with a value of 1 to 2.

Equation 2 expresses characteristic data including k, α, Vt and β in relation to the driving current Id and the driving voltage Vdata of the pixels PX. The compensator 500 stores the compensation data COD for compensating the driving current Id flowing to the driving transistor TR2 by using characteristic data defined in Equation 2.

In an embodiment, the compensator 500 generates deviations of the driving voltages Vdata generated by respective degradations of the pixels PX as compensation data COD with respect to the driving current Id that corresponds to target luminance in the initial operation. Ideally, it is desirable for the compensator 500 to set the increment and decrement amounts α and β of the mobility characteristic variable k and the threshold voltage characteristic variable Vt, respectively, as 0.

Figure 3:
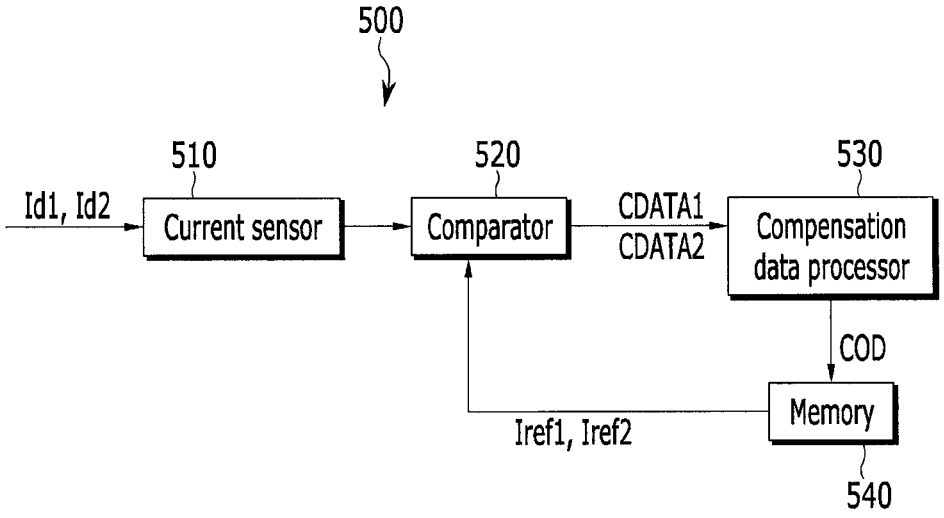
FIG. 3 shows a detailed block diagram of a compensator, according to an example embodiment of the present invention.

FIG. 3 shows a detailed block diagram of the compensator 500 according to an example embodiment of the present invention.

Referring to FIG. 3, the compensator 500 includes a current sensor 510, a comparator 520, a compensation data processor 530, and a memory 540. The current sensor 510 includes a plurality of switches SW (e.g., refer to FIG. 2) for electrically coupling drain terminals of the driving transistors TR2 of the pixels PX to the sense lines according to the sense signals SE1-SEn. The current sensor 510 generates a plurality of sense signals SE1-SEn, and sequentially turns on the switches SW in the compensation mode.

The current sensor 510 senses the first and second driving currents Id1 and Id2 flowing to the respective driving transistors TR2 of the pixel PX corresponding to the first and second test data TD1 and TD2. The current sensor 510 according to the example embodiment of the present invention has been described to sense the first and second driving currents Id1 and Id2 for the pixels PX, and without being restricted to this, the current sensor 510 can sense the first and second driving currents Id1 and Id2 for selected ones from among the pixels PX.

The comparator 520 reads first and second reference currents Iref1 and Iref2 from the memory 540, compares the first driving current Id1 and the first reference current Iref1, outputs first comparison data CDATA1, compares the second driving current Id2 and the second reference current Iref2, and outputs the second comparison data CDATA2.

The compensation data processor 530 updates the compensation data COD stored in the memory 540 by changing at least one of the mobility characteristic variable k and the threshold voltage characteristic variable Vt according to the first and second comparison data CDATA1 and CDATA2.

Without being restricted to this, in an example embodiment of the present invention, when the compensation data COD for the respective pixels PX are sensed and updated, address information of the corresponding pixel PX can be stored in the memory 540. In one embodiment, the memory 540 may include a non-volatile memory. Therefore, address information on the updated pixel PX is acquired when a power supply of the display device is stopped (e.g., when the display is turned off) while the compensation data COD of all pixels PX are sensed and updated. Accordingly, the compensation data COD may continue to be sensed and updated (e.g., be repeatedly sensed and updated) by using the address information stored in the memory 540 after the power is supplied again, as the data stored in the memory may not be lost when power is not supplied. In one example, an additional memory for storing the address information may be used.

Figure 4:
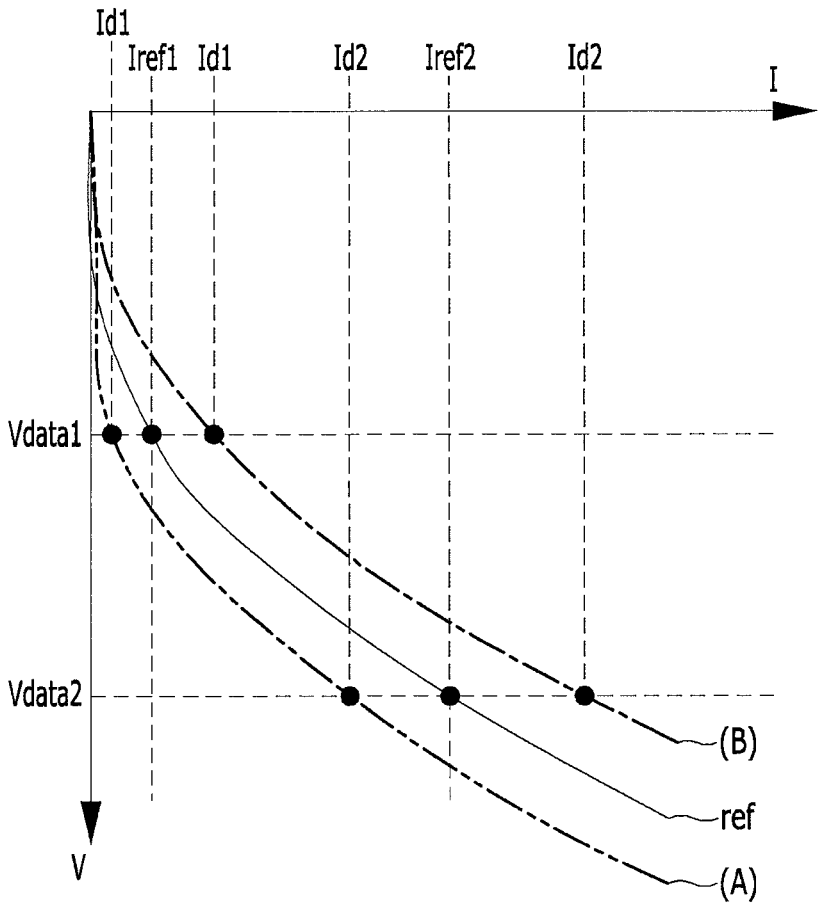
FIGS. 4-6 show V-I graphs of a driving transistor.
Figure 5:
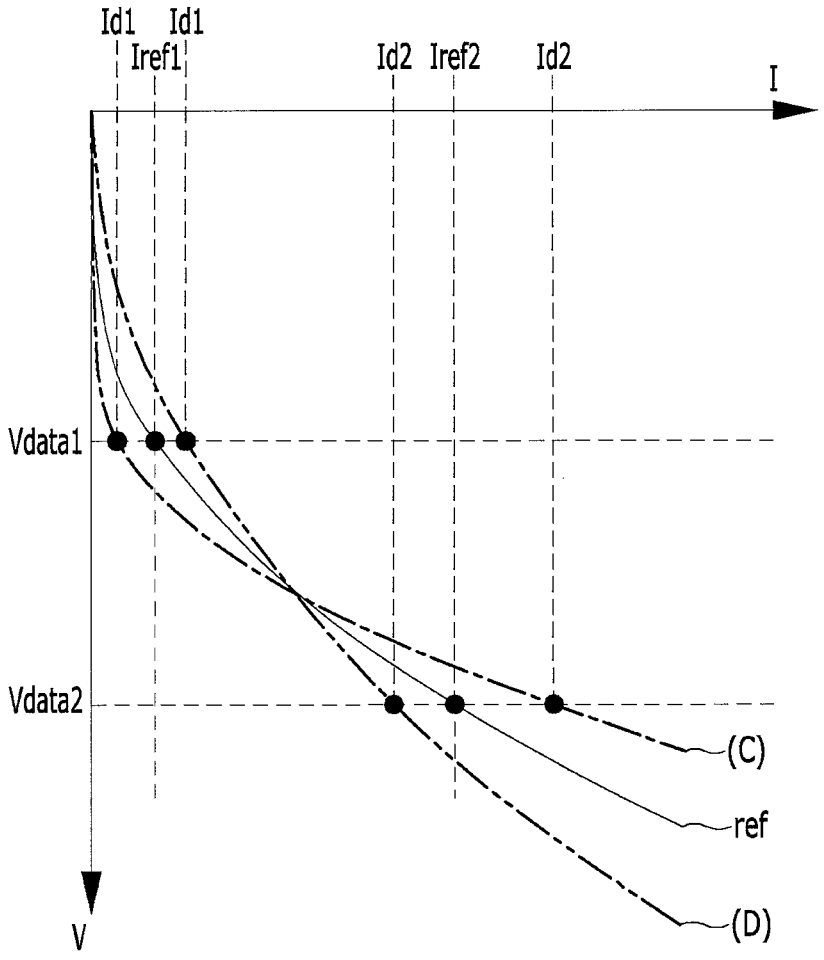
Figure 6:
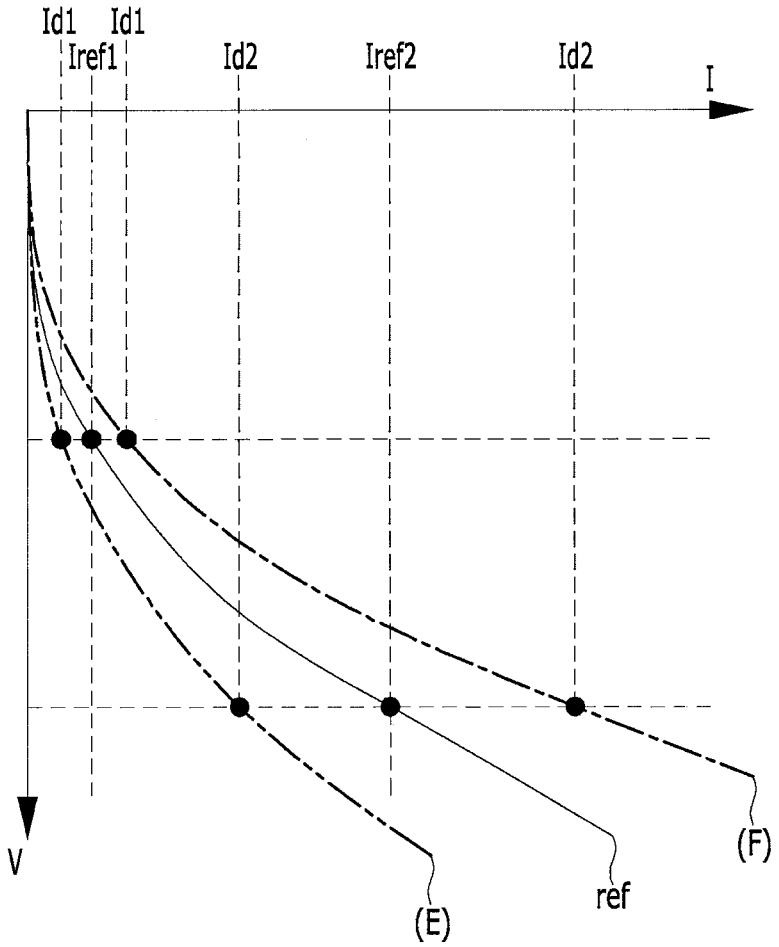

Referring to FIGS. 4-6, an operation of the compensation data processor 530 will now be described in detail.

FIGS. 4-6 show example V-I graphs of a driving transistor. In these examples, a data signal that corresponds to the first test data TD1 is given as Vdata1, and a data signal that corresponds to the second test data TD2 is given as Vdata2. Further, a V-I curve that corresponds to the first and second reference currents Iref1 and Iref2 is indicated as ref.

Referring to FIG. 4, the compensation data processor 530 sets the variation β of the threshold voltage characteristic variable Vt as +1 and updates the compensation data COD when the first driving current Id1 is less than the first reference current Iref1 and the second driving current Id2 is less than the second reference current Iref2 (shown by (A)).

The compensation data processor 530 sets the variation β of the threshold voltage characteristic variable Vt as −1 and updates the compensation data COD when the first driving current Id1 is greater than the first reference current Iref1 and the second driving current Id2 is greater than the second reference current Iref2 (shown by (B)).

Thus, the compensation data processor 530 changes the threshold voltage characteristic variable Vt when the first and second driving currents Id1 and Id2 are both less or both greater than the corresponding first and second reference currents Iref1 and Iref2.

However, referring to FIG. 5, the compensation data processor 530 sets the variation α of the mobility characteristic variable k and the variation β of the threshold voltage characteristic variable Vt as −1 and updates the compensation data COD when the first driving current Id1 is less than the first reference current Iref1 and the second driving current Id2 is greater than the second reference current Iref2 (shown by (C)).

On the contrary, the compensation data processor 530 sets the variation α of the mobility characteristic variable k and the variation β of the threshold voltage characteristic variable Vt as +1 and updates the compensation data COD when the first driving current Id1 is greater than the first reference current Iref1 and the second driving current Id2 is less than the second reference current Iref2 (shown by (D)).

Thus, the compensation data processor 530 changes the threshold voltage characteristic variable Vt and the mobility characteristic variable k when one of the first driving current Id1 and the second driving current Id2 is greater than the first and second reference currents Iref1 and Iref2 and the other is less than them.

The example embodiment of the present invention is not restricted to the above-described configuration, and the compensation data processor 530 can change the mobility characteristic variable k when the first and second driving currents Id1 and Id2 are less or greater than the corresponding first and second reference currents Iref1 and Iref2.

According to an embodiment, as shown in FIG. 6, the compensation data processor 530 sets the variation α of the mobility characteristic variable k as −1 and updates the compensation data COD when the first driving current Id1 is less than the first reference current Iref1 and the second driving current Id2 is less than the second reference current Iref2 (shown by (E)).

The compensation data processor 530 sets the variation α of the mobility characteristic variable k as +1 and updates the compensation data COD when the first driving current Id1 is greater than the first reference current Iref1 and the second driving current Id2 is greater than the second reference current Iref2 (shown by (F)).

While this invention has been described in connection with what is presently considered to be practical example embodiments, it is to be understood that the invention is not limited to the disclosed embodiments, but, on the contrary, is intended to cover various suitable modifications and equivalent arrangements included within the spirit and scope of the appended claims and equivalents thereof.

What is claimed is:

1. An organic light emitting diode display comprising:

a display comprising a plurality of data lines, a plurality of scan lines, a plurality of sense lines, and a plurality of pixels electrically coupled to the data lines, the scan lines, and the sense lines;

a compensator configured to sense first driving currents and second driving currents flowing to the pixels corresponding to first test data and second test data, respectively, in a compensation mode, to compare first reference currents and second reference currents with the first driving currents and the second driving currents, respectively, and to update compensation data corresponding to a variation of a mobility characteristic variable and a variation of a threshold voltage characteristic variable by selectively increasing or decreasing at least one of the variation of the mobility characteristic variable and the variation of the threshold voltage characteristic variable based on a result of the comparison;

a signal controller configured to compensate input data according to the compensation data to generate image data, and to change the input data into the first test data and the second test data in the compensation mode; and a data driver configured to generate a plurality of data signals by using one of the image data, the first test data, and the second test data, and to supply the data signals to the data lines.

2. The organic light emitting diode display of claim 1, wherein the compensator comprises:

a current sensor configured to sense the first driving currents and the second driving currents through the sense lines in the compensation mode;

a comparator configured to compare the first driving currents with the first reference currents to output first comparison data, and to compare the second driving currents with the second reference currents to output second comparison data;

a compensation data processor configured to update the compensation data according to the first comparison data and the second comparison data; and a memory configured to store value of the first reference currents, value of the second reference currents, and the compensation data.

3. The organic light emitting diode display of claim 2, wherein each of the pixels comprises:

an organic light emitting diode; and a driving transistor configured to drive the organic light emitting diode according to one of the data signals.

4. An organic light emitting diode display comprising:

a display comprising a plurality of data lines, a plurality of scan lines, a plurality of sense lines, and a plurality of pixels electrically coupled to the data lines, the scan lines, and the sense lines;

a compensator configured to sense first driving currents and second driving currents flowing to the pixels corresponding to first test data and second test data, respectively, in a compensation mode, to compare first reference currents and second reference currents with the first driving currents and the second driving currents, respectively, and to update compensation data;

a signal controller configured to compensate input data according to the compensation data to generate image data, and to change the input data into the first test data and the second test data in the compensation mode; and a data driver configured to generate a plurality of data signals by using one of the image data, the first test data, and the second test data, and to supply the data signals to the data lines, wherein each of the pixels comprises:

an organic light emitting diode; and a driving transistor configured to drive the organic light emitting diode according to one of the data signals, wherein the compensator comprises:

a current sensor configured to sense the first driving currents and the second driving currents through the sense lines in the compensation mode;

a comparator configured to compare the first driving currents with the first reference currents to output first comparison data, and to compare the second driving currents with the second reference currents to output second comparison data;

a compensation data processor configured to update the compensation data according to the first comparison data and the second comparison data; and a memory configured to store value of the first reference currents, value of the second reference currents, and the compensation data, and wherein characteristic data of the driving transistor comprising a mobility characteristic variable, a variation of the mobility characteristic variable, a threshold voltage characteristic variable, and a variation of the threshold voltage characteristic variable, are related according to $$Id=(k+\alpha)\times\{V\text{data}-(Vt-\beta))^P\}$$

where the Id is a current flowing to the driving transistor, the Vdata is a voltage corresponding to the data signal, k is the mobility characteristic variable, Vt is the threshold voltage characteristic variable, $\alpha$ is the variation of the mobility characteristic variable, $\beta$ is the variation of the threshold voltage characteristic variable, and P is a constant with a value of 1 to 2.

5. The organic light emitting diode display of claim 4, wherein the compensation data processor is further configured to store value of the first driving currents and value of the second driving currents flowing to the pixels in the memory as value of the first reference currents and value of the second reference currents, according to the first test data and the second test data at an initial operation.

6. The organic light emitting diode display of claim 4, wherein the compensation data processor is further configured to set the variation of the mobility characteristic, variable and the variation of the threshold voltage characteristic variable as 0 at an initial operation.

7. The organic light emitting diode display of claim 4, wherein the compensation data processor is further configured to change the variation of at least one of the mobility characteristic variable or the threshold voltage characteristic variable by ±1 according to the first comparison data and the second comparison data.

8. The organic light emitting diode display of claim 7, wherein the compensation data processor is further configured to change the variation of the threshold voltage characteristic variable by +1 when a corresponding one of the first driving currents is less than a corresponding one of the first reference currents and a corresponding one of the second driving currents is less than a corresponding one of the second reference currents.

9. The organic light emitting diode display of claim 7, wherein the compensation data processor is further configured to change the variation of the threshold voltage characteristic variable by −1 when a corresponding one of the first driving currents is greater than a corresponding one of the first reference currents and a corresponding one of the second driving currents is greater than a corresponding one of the second reference currents.

10. The organic light emitting diode display of claim 7, wherein the compensation data processor is further configured to change the variation of the mobility characteristic variable and the variation of the threshold voltage characteristic variable by −1 when a corresponding one of the first driving currents is less than a corresponding one of the first reference currents and a corresponding one of the second driving currents is greater than a corresponding one of the second reference currents.

11. The organic light emitting diode display of claim 7, wherein the compensation data processor is further configured to change the variation of the mobility characteristic variable and the variation of the threshold voltage characteristic variable as +1 when a corresponding one of the first driving currents is greater than a corresponding one of the first reference currents and a corresponding one of the second driving currents is less than a corresponding one of the second reference currents.

12. The organic light emitting diode display of claim 7, wherein the compensation data processor is farther configured to change the variation of the mobility characteristic variable by −1 when a corresponding one of the first driving currents is less than a corresponding one of the first reference currents and a corresponding one of the second driving currents is less than a corresponding one of the second reference currents.

13. The organic light emitting diode display of claim 7, wherein the compensation data processor is further configured to change the variation of the mobility characteristic variable by +1 when a corresponding one of the first driving currents is greater than a corresponding one of the first reference currents and a corresponding one of the second driving currents is greater than a corresponding one of the second reference currents.

* * * * *